US005567171A

United States Patent [19]

Mizuguchi

[11] Patent Number: 5,567,171

[45] Date of Patent: Oct. 22, 1996

[54] ELECTRICAL CONNECTOR WITH A LATCH

[75] Inventor: Shinji Mizuguchi, Tokyo, Japan

[73] Assignee: Hirose Electric Co., Ltd., Tokyo, Japan

[21] Appl. No.: 303,759

[22] Filed: Sep. 9, 1994

[30] Foreign Application Priority Data

Oct. 8, 1993 [JP] Japan ..... 5-054867

[51] Int. Cl.[6] ..... H01R 13/62

[52] U.S. Cl. ..... 439/326; 439/630

[58] Field of Search ..... 439/326, 327, 439/328, 325, 630–637, 59, 61, 62

[56] References Cited

U.S. PATENT DOCUMENTS

| | | | |
|---|---|---|---|
| 3,920,303 | 11/1975 | Pittman et al. | 439/326 |
| 4,946,403 | 8/1990 | Billman et al. | 439/631 |
| 4,984,996 | 1/1991 | Watanabe et al. | 439/326 |
| 5,002,494 | 3/1991 | Olsson | 439/632 |
| 5,041,005 | 8/1991 | McHugh | 439/326 |
| 5,161,994 | 11/1992 | Sato et al. | 439/326 |
| 5,259,768 | 11/1993 | Brunker et al. | 439/60 |
| 5,259,793 | 11/1993 | Yamada et al. | 439/751 |

*Primary Examiner*—Hien D. Vu

*Attorney, Agent, or Firm*—Kanesaka & Takeuchi

[57] ABSTRACT

An electrical connector with a latch includes an insulating housing having a base which has an elongated groove, and first and second contact receiving cavities provided on upper and lower sides of the elongated groove, respectively; first and second contact elements arranged in the first and second contact receiving cavities, respectively, such that contact portions of the first and second contact elements exposed in the elongated groove respectively; a front end face of the first contact receiving cavities being offset from a front end face of the second contact receiving cavities by a predetermined length; a guide slope provided on an upper front edge of the elongated groove for guiding a circuit board into the elongated groove; the contact portions of the first contact elements project into the elongated groove beyond an extended line of the guide slope; and a shortest distance between the contact portions of the first and second contact elements being set slightly less than a thickness of the circuit board.

4 Claims, 4 Drawing Sheets

ELECTRICAL CONNECTOR WITH A LATCH

BACKGROUND OF THE INVENTION

1. Field of the Invention

The present invention relates to electrical connectors with a latch for connecting circuit boards.

2. Description of the Related Art

Electrical connectors mounted on a mother board for receiving a daughter board thereby connecting these circuit boards are well known. The density of IC memories mounted in a single in-line memory module for a computer, etc. has increased so that it is frequent to mount IC memories on both sides of a circuit board. An electrical connector capable of receiving such a circuit board has been proposed. The plugging force for the circuit board that has 50 terminals or more is very large.

In order to increase the mount density, the thickness of circuit boards has been reduced so that there is the danger of warping of the boards under such large plugging forces. If there is any warping, the solder of IC memories can suffer microcracks. Accordingly, there is a demand for an electrical connector which requires small plugging force.

In order to meet the demand, an electrical connector with a latch has been proposed. This connector has a housing with an elongated groove into which a circuit board is inserted obliquely and then turned clockwise to a predetermined angle for latch.

Japanese UM patent application Kokai No. 61-206278 and U.S. Pat. No. 4,960,386 disclose rotary ZIF connectors wherein opposed terminals are spaced such that the distance between the contact points before a circuit board is inserted obliquely is larger than the distance between the contact points in contact with the inserted board thereby minimizing the plugging forces.

In the rotary low-plugging force connectors, the circuit board is not brought into contact with the terminals during insertion but upon rotation made after the insertion. No consideration is made for wiping action by which the contact points are cleaned to thereby prevent poor contact.

In the above Japanese UM Patent application, the distance between terminals before insertion is set equal to or larger than the thickness of a circuit board to be inserted, and nowhere is there any suggestion about the wiping action.

In the U.S. Pat. No. 4,960,386, the connector has no board guides, and the terminals are exposed so that if the contacts are warped, a circuit board abuts on the terminals and deforms them. Accordingly, the distance between the terminals is set larger than the thickness of the circuit board, thus providing no wiping action.

In either case, the wiping action is eliminated in order to keep the plugging force low. As a result, dirt and dust accumulate on the terminals after a while, causing poor contact.

In addition, the large terminal distance makes the connector large, failing to meet the demand for a high density, low profile connector.

SUMMARY OF THE INVENTION

Accordingly, it is an object of the invention to provide a low profile electrical connector with a latch, which provides a wiping action and needs only a low plugging force.

According to the invention there is provided an electrical connector with a latch includes an insulating housing having a base which has an elongated groove, and first and second contact element receiving cavities provided on upper and lower sides of the elongated groove, respectively; first and second contact elements arranged in the first and second contact receiving cavities, respectively, such that contact portions of the first and second contact elements exposed in the elongated groove respectively; a front end face of the first contact receiving cavities being offset from a front end face of the second contact receiving cavities by a predetermined length; a guide slope provided on an upper front edge of the elongated groove for guiding a circuit board into the elongated groove; the contact portions of the first contact elements project into the elongated groove slightly beyond an extended line of the guide slope; and a shortest distance between the contact portions of the first and second contact elements being set slightly less than a thickness of the circuit board.

DESCRIPTION OF PREFERRED EMBODIMENTS

Figure 1:
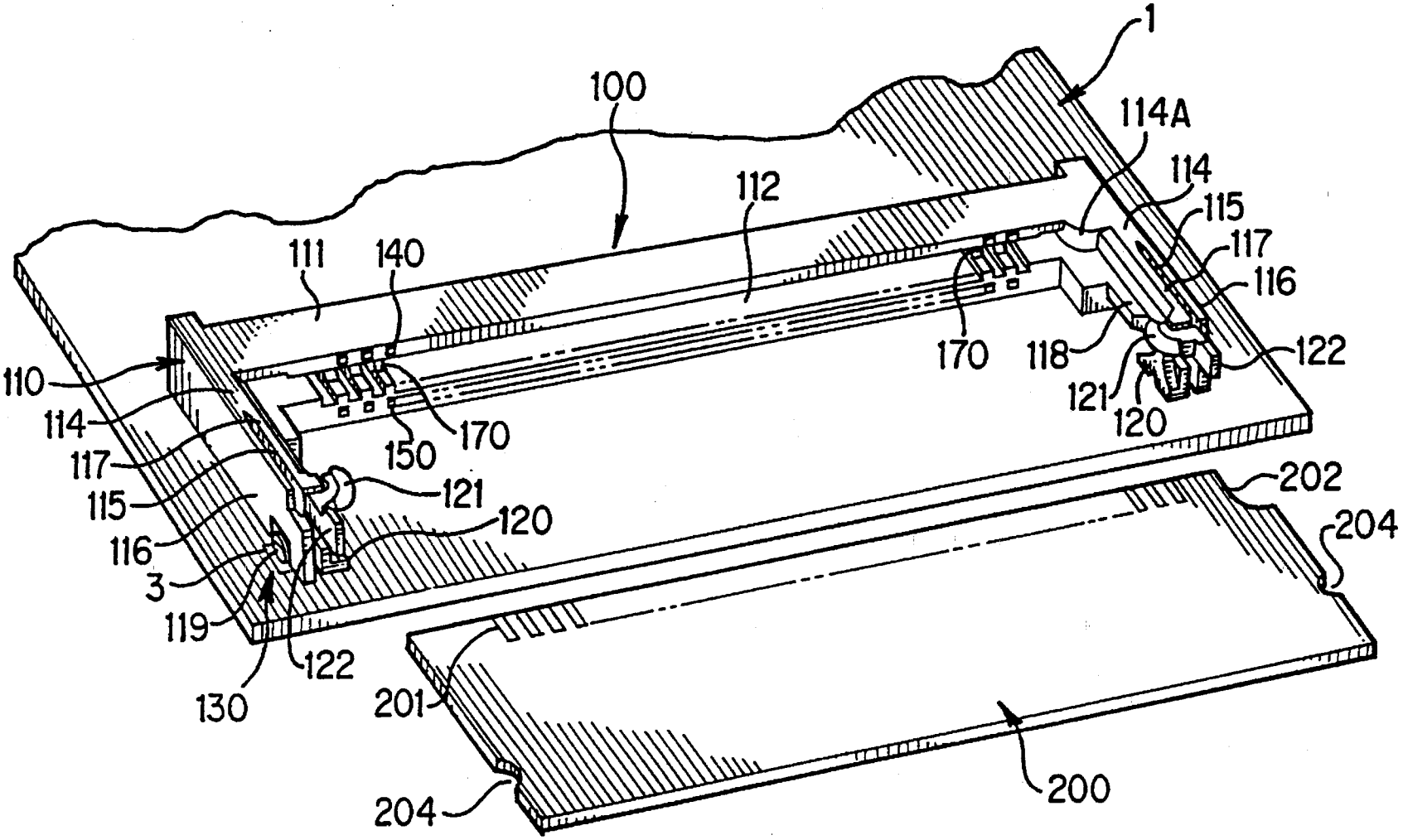
FIG. 1 is a perspective view of an electrical connector with a latch for connecting a daughter board to a mother board.
Figure 2:
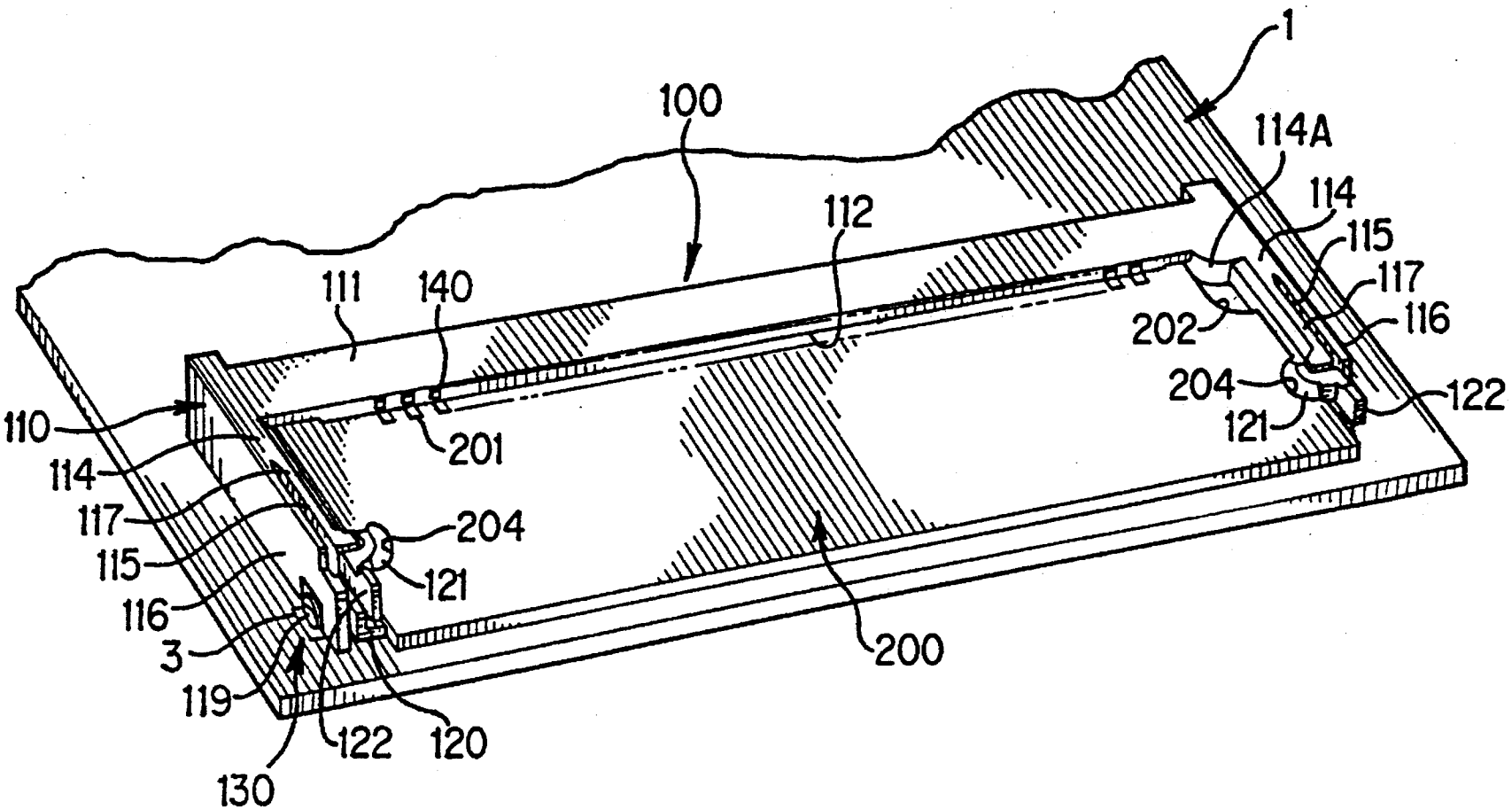
FIG. 2 is the electrical connector which has connected a daughter board to a mother board.

In FIGS. 1 and 2, an electrical connector 100 having a latch includes a housing 110 integrally molded from an insulating material such as plastic. The housing 110 includes a base 111 having an elongated groove 112 and a pair of side walls 114 extending forwardly from opposite ends of the base 111. The housing 110 is adapted to be mounted on a mother board such that the respective terminals are brought into contact with the circuit conductors.

Each side wall 114 is provided with a slit 115 to form an outer fixed arm 116 and an inner first movable arm 117. A second movable arm 120 extends inwardly from the lower end of the first movable arm 117. A latch piece 121 is provided on the front end of the second movable arm 120. An operation lever 122 is coupled to the top of the latch piece 121. The first movable arm 117, the second movable arm 120, and the latch piece 121 constitutes a latch. A support face 118 is provided on the lower inside of the each side wall 114 to abut on the back side of a daughter board 200 for support.

A number of contact points 201 are arranged along the front edge of the daughter board 200 such that the upper contact points 201 are offset by a half pitch with respect to the lower contact points (not shown) arranged on the back side of the daughter board 200. A cutout 202 is formed on a front corner of the board 200 to fit over a projection 114A provided on the rear inner portion of the side wall 114 for preventing wrong plugging. A pair of semi-circular latch notches 204 are formed on opposite sides of the board 200.

Figure 3:
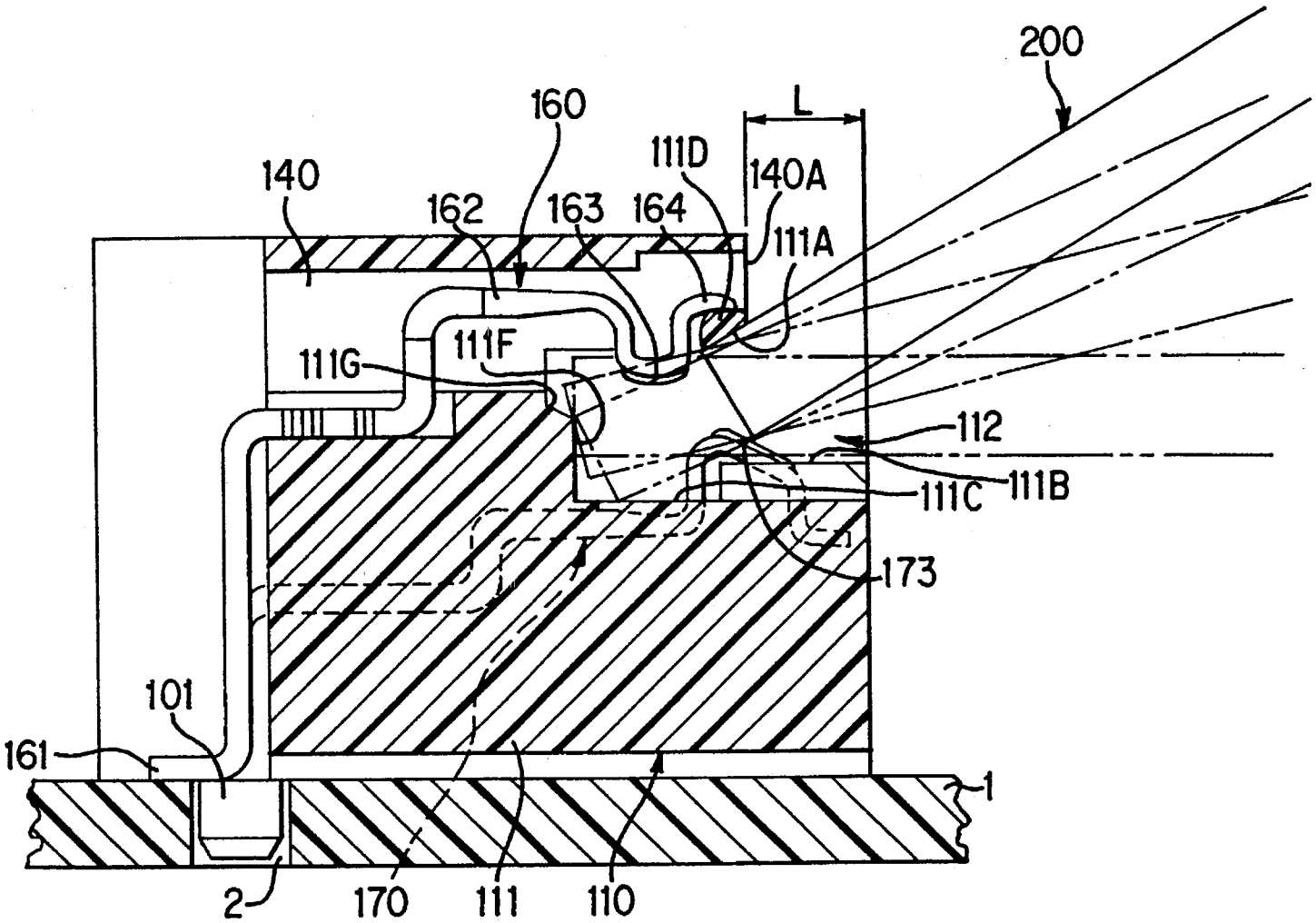
FIG. 3 is a sectional view of the electrical connector taken along a first type contact element receiving cavity.
Figure 4:
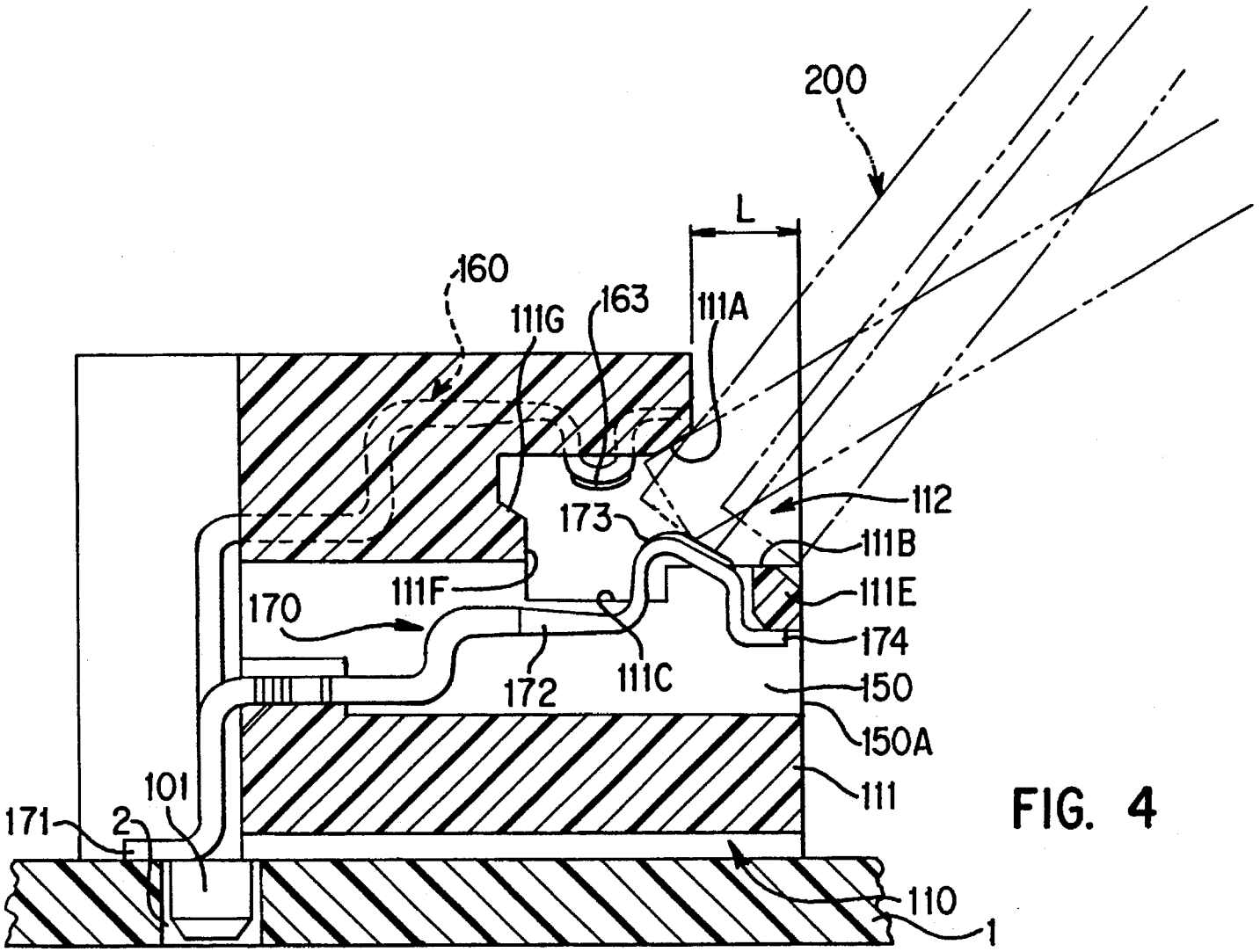
FIG. 4 is a sectional view of the electrical connector taken along a second type contact element receiving cavity.

In FIGS. 3 and 4, a pair of studs 101 extend downwardly from the lower rear portion of the base 111 to fit into apertures 2 of the mother board 1 for positioning and securing the housing 110. As best shown in FIGS. 1 and 2, a press-fit recess 119 is formed on the lower front portion of each side wall 114 for frictionally receiving a fastener 130. By securing with a solder 3 the fasteners 130 to the mother board 1 it is possible to secure the fixed arms 116 to the mother board 1 for mounting the connector 100 on the board 1.

As best shown in FIG. 3, a number of contact element receiving cavities 140 extend rearwardly from an upper front opening 140A through the base 111 between the top wall and the elongated groove 112 with a pitch equal to that of the contact points 201 on the upper side of the board 200. Similarly, as best shown in FIG. 4, a number of contact element receiving cavities 150 extend rearwardly from a lower front opening 150A through the base 111 between the bottom wall and the elongated groove 112 with a pitch equal to that of the contact points on the back side of the board 200.

A number of first type contact elements 160 are placed in the receiving cavities 140 while a number of second type contact elements 170 are placed in the receiving cavities 150. The first type contact elements 160 are made by stamping, rolling, and bending spring conductive sheet. The second type contact elements 170 are made independently from the first type in the same manner.

As best shown in FIG. 3, the first type contact element 160 has a connection portion 161, a spring portion 162, a contact portion 163, and an engaging portion 164. Similarly, as best shown in FIG. 4, the second type contact element 170 has a connection portion 171, a spring portion 172, a contact portion 173, and an engaging portion 174.

The contact portions 163 and 173 of the contact elements 160 and 170 are provided with a C-shaped rolled surface. The portion between the spring portion 162 or 172 and the connection portion 161 or 171 gradually increases in thickness and is bent in S-shape so as to minimize not only the length of the contact element but also the stiffness.

The connection portion 161 of the first type contact element 160 is press fitted in the base 111 of the housing 110 such that the engaging portion 164 engages the front edge 111D of the contact element receiving cavity 140 while the contact portion 163.exposes in the elongated groove 112. The respective portions are sized such that the spring portion 162 is preloaded or biased by the engagement of the engaging portion 164 with the front edge 111D.

Similarly, the connection portion 171 of the second type contact element 170 is press fitted in the base 111 of the housing 110 such that the engaging portion 174 engages the front edge 111E while the contact portion 173 exposes in the elongated groove 112 of the contact element receiving cavity 150. The respective portions are sized such that the spring portion 172 is preloaded or biased by the engagement of the engaging portion 174 with the front edge 111E.

From FIGS. 3 and 4 it is apparent that the contact portions 163 and 173 of the first and second types of contact elements 160 and 163 are offset by a half pitch. The contact portion 173 is set in the elongated groove 112 lower and more forward than the contact portion 163. The distance between the contact portions 163 and 173 in the direction perpendicular to the direction of insertion of a daughter board 200 is set slightly less than the thickness of the board 200 so that the plugging force is minimized. The distance between the contact portions 163 and 173 in the direction perpendicular to the bottom 111C of the elongated groove 112, however, is set less than the thickness of the board 200 so that the respective contact portions 163 and 173 are pressed against the corresponding contact points 210 of the board 200 with sufficient forces to make good contact.

The front openings 140A and 150A of the contact element receiving cavities 140 and 150 are offset by a length of L. A guide slope 111A is provided on the upper front edge of the elongated groove 112. The contact portion 163 of the first type contact element 160 is made to project beyond an extended line of the guide slope 111A.

The elongated groove 112 has the first guide face 111B extending rearwardly from the front face of the base 111, the second guide face or bottom 111C, and the third guide face or rear wall 111F, which is provided with the fourth guide face slope 111G. The distance of contact points between the contact portions 163 and 173 as viewed from a line perpendicular to the guide slope 111A is set slightly less than the thickness of a board 200.

In operation, a daughter board 200 is inserted into the elongated groove 112 along the guide slope 111A as shown by solid line in FIG. 3. The contact points 201 on the back of the board 200 are brought into contact with the contact portions 173 of the second type contact elements 170 pushing downwardly the contact portions 173. The contact pressure provides a wiping action by which the contact points 201 and the contact portions 173 are cleaned.

As soon as the contact points 201 on the back of the board 200 are wiped, the upper front edge of the board 200 is brought into contact with the contact portions 163 of the first type contact elements 160 pushing upwardly the contact portions 163. Consequently, the wiping action clean the contact points of the contact portions 163 and the contact points 201 on the upper front edge of the board 200. When the board 200 is further inserted into the elongated groove 112, the lower front edge of the board 200 abuts on and slides forwardly along the second guide face 111C so that the board 200 is turned clockwise by a certain angle as shown by broken line in FIG. 3, and finally the front end of the board 200 abuts against the third guide face 111F.

Then, the board 200 is turned clockwise to the horizontal position to rest on the support faces 118 of the side walls 114 as shown in FIG. 1 so that the engaging notches 204 of the board 200 abut on the latch pieces 121 of the second movable arms 120. The second movable arms 120 are forcibly moved outwardly along with the first movable arms 117 allowing the notches 204 to pass the latch pieces 121. It is preferred that the inner side faces of the notches 204 are tapered so as to facilitate movement of the board 200 pass the latch pieces 121.

When the board 200 is supported by the support faces 118 of the side walls 114 in the horizontal position, the first and second movable arms 117 and 120 return by their own resilient forces to the respective original positions so that the latch pieces 121 return to the original position to hold the board 200 in place as shown in FIG. 2. The board 200 is held in the horizontal position between the support faces 118 and the latch pieces 121. The board 200 is locked or prevented from falling off by the engagement of the notches 204 with the latch pieces 121. The contact points 201 of the board 200 are in contact with the contact portions 163 and 173 of the first and second type contact elements 160 and 170. The fourth guide slope 111G provides an escape for the upper front edge of the board 200 to facilitate the rotation of the board 200 to the horizontal position.

In order to remove the board 200, the operation levers 122 are moved outwardly so that the latch pieces 121 are released from the notches 204 of the board 200. Consequently, the board 200 is turned counterclockwise by the spring forces of the first and second type contact elements 160 and 170 so that it can be pulled out from the elongated groove 112. During the pulling out action, the contact portions 163 and 173 of the contact elements 160 and 170 are rubbed against the contact points 201 on the upper and lower surfaces of the board 200 so that the contact portions 163 and 173 and the contact points 201 are cleaned by the wiping action.

The board 200 can be inserted into the elongated groove 112 in various directions. For example, the board 200 can be inserted such that the lower front edge of the board 200 abuts against the first guide face 111B as shown in FIG. 4. With the connector 100 according to the invention, it is possible that the board 200 slides on the first guide face 111B and is guided into the elongated groove 112.

The board 200 is then turned clockwise and further inserted into the elongated groove 112 at a different angle. The lower front edge of the board 200 now abuts the contact portions 173 of the second type contact elements 170 moving the contact portions 173 downwardly for further insertion. As a result, the board 200 is turned to the position parallel to the guide slope 111A. The subsequent operation is the same as in FIG. 3. Thus, the contact points 201 of the board 200 and the contact portions 163 and 173 of the contact elements 160 and 170 are cleaned by the wiping action.

Alternatively, the second movable arms and the latch pieces may be made of metal so that the latch mechanism can be thinner and stronger than the above embodiment. The same advantages of the connector can be obtained when the mother board is positioned horizontally, vertically, or obliquely. The height of the connector can be set at will to provide the same results.

Since the front openings of the contact element receiving cavities for the first and second type contact elements are offset and since the contact portions of the first type contact elements slightly project beyond an extended line of the guide slope provided on the upper front edge of the elongated groove, the movement and timing of the contact portions of the first and second type contact elements as a daughter board is inserted are different, thereby reducing the plugging force and providing the wiping action. The wiping action cleans the electrical contacts thereby increasing the reliability of the connector.

In other words, by offsetting the front openings of the respective contact element receiving cavities, the insertion angle is made large so that the apparent distance between the contact points is made large without changing the distance of contact points between the first and second contact elements. In addition, the plugging force is minimized without increasing the distance of contact points.

Since the distance of contact points is set less than the thickness of a board, the wiping action is effected without failure. The first and second guide faces for the second type contact element receiving cavity guide the insertion of a daughter board so that the contact elements are protected against damage. By such a guided rotation of the board, the movement of the first type contact elements is increased so that not only the wiping action is assured but also the plugging force is minimized because the board is in abutment with the contact portions of the second type contact elements.

I claim:

1. An electrical connector with a latch, into which a circuit board is inserted at an angle and then rotated to a latch position, comprising:

an insulating housing having a base which has an elongated groove, and first and second contact element receiving cavities provided on upper and lower sides of said elongated groove;

first and second discrete contact elements arranged in said first and second contact receiving cavities, respectively, such that contact portions of said first and second contact elements exposed in said elongated groove respectively;

a front end face of said first contact element receiving cavities being offset from a front end face of said second contact element receiving cavities by a predetermined length (L);

a guide slope provided on an upper front edge of said elongated groove for guiding said circuit board into said elongated groove;

said contact portions of said first contact elements project into said elongated groove beyond an extended line of said guide slope;

a shortest distance between said contact portions of said first and second contact elements being set slightly less than a thickness of said circuit board so that when said circuit board is inserted into said elongated groove along said guide slope, said contact portions are cleaned by wiping action of said circuit board before said circuit board is rotated to a latch position; and Wherein said contact portions each has a C-shaped rolled surface so that when a circuit board is inserted into said elongated groove, said C-shaped rolled surface make a smooth sliding contact with said circuit board, thus providing improved cleaning action by wiping.

2. The electrical connector with a latch according to claim 1, wherein said elongated groove includes a first guide face extending rearwardly from a front end face of said base and a second guide face extending in a plane lower than and parallel to said first guide face for guiding a circuit board into said elongated groove.

3. The electrical connector with a latch according to claim 2, wherein said elongated groove further includes a third guide face extending upwardly from a rear edge of said second guide face and a fourth guide face slope extending upwardly and rearwardly from an upper edge of said third guide surface for providing a fulcrum edge between them and an escape for an upper edge of said circuit board being inserted and rotated about said fulcrum edge, said third guide face having a length such that a front end face of said circuit board abuts against said fulcrum edge upon insertion along said guide slope thereby eliminating necessity to further push said circuit board into said elongated groove after it is rotated to said latch position.

4. An electrical connector with a latch, into which a circuit board is inserted and then rotated to a latch position, comprising:

an insulating housing with an elongated base having a front mating face and a rear face opposite to said mating face;

an elongated groove extends rearwardly from said front mating face of said base;

a plurality of upper contact receiving cavities extend from said rear face to said mating face and having a lower opening between a lower front edge portion and a rear bottom portion for communication with said elongated groove;

a plurality of lower contact receiving cavities extend from said rear face to said mating face and having an upper opening between an upper front edge portion and a ceiling portion for communication with said elongated groove;

a plurality of upper contact elements provided in said upper contact receiving cavities such that contact portions project into said elongated groove through said lower opening while front end portions are engaged with said lower opening while front end portions are engaged with said lower front edge portions so that said upper contact elements are not only preloaded but also protected from damage;

a plurality of lower contact elements provided in said lower contact receiving cavities such that contact portions project into said elongated groove through said upper opening while front end portions are engaged with said upper front edge portions so that said lower contact elements are not only preloaded but also protected from damage Wherein said contact portions each has a C-shaped rolled surface so that when a circuit board is inserted into said elongated groove, said rolled surface make a smooth sliding contact with said circuit board, thus providing improved cleaning action by wiping; and Wherein said upper contact elements and lower contact elements are discrete contact elements.

* * * * *